US005388530A

United States Patent [19]

Jacobus

[11] Patent Number: 5,388,530

[45] Date of Patent: Feb. 14, 1995

[54] LAP TOP DESK

[76] Inventor: Frederick B. Jacobus, 2915 Alta Vista Dr., Newport Beach, Calif. 92660

[21] Appl. No.: 28,236

[22] Filed: Mar. 9, 1993

[51] Int. Cl.[6] ..... A47B 23/00

[52] U.S. Cl. ..... 108/43; 108/63

[58] Field of Search ..... 108/43, 63; 16/319, 16/327, 328, 362, 363, 352, 353; 248/454

[56] References Cited

U.S. PATENT DOCUMENTS

| | | | |
|---|---|---|---|
| D. 164,269 | 8/1951 | Whittier . | |
| D. 254,794 | 4/1980 | Hayman . | |
| 127,741 | 6/1872 | Closterman . | |
| 234,667 | 11/1880 | Gould . | |
| 287,030 | 10/1883 | King . | |
| 719,625 | 2/1903 | Throm . | |
| 1,159,135 | 11/1915 | Umanoff . | |
| 2,102,449 | 12/1937 | Zimmerman | 108/63 |
| 2,221,182 | 11/1940 | Davies . | |
| 2,260,482 | 10/1941 | Roberts . | |
| 2,462,304 | 2/1949 | Burdick . | |
| 2,703,254 | 3/1955 | Shockey . | |
| 2,745,202 | 5/1956 | Wood | 108/43 |
| 3,159,421 | 12/1964 | Samuelson . | |
| 3,246,914 | 4/1966 | Goodwin . | |
| 3,353,206 | 11/1967 | Kerman | 16/328 |
| 3,541,976 | 11/1970 | Rozas | 108/43 |
| 3,670,370 | 6/1972 | Goodwin . | |
| 3,791,314 | 2/1974 | Beretta . | |
| 3,848,547 | 11/1974 | Schaefer . | |
| 3,910,627 | 10/1975 | Meyer . | |
| 4,243,249 | 1/1981 | Goss . | |
| 5,167,394 | 12/1992 | Hegarty | 248/454 |
| 5,221,070 | 6/1993 | Heilmor | 248/454 X |

FOREIGN PATENT DOCUMENTS

| | | | |
|---|---|---|---|
| 5478 | 9/1987 | WIPO | 297/162 |

*Primary Examiner*—José V. Chen

*Attorney, Agent, or Firm*—Poms, Smith, Lande & Rose

[57] ABSTRACT

A lap top desk includes a pair of stacked and spaced apart plate-like members which both provide respective work surfaces to a user of the desk, and which are both pivotally and translatably connected so that the user may refer to a portion of the lower member while also keeping all of the upper work surface in sight. Alternatively, the user may choose to pivot the upper member work surface out of sight in order to completely reveal the work surface of the lower member. A dual function strap is provided which when sat upon by the user keeps the desk on the lap, and which also secures the desk in a storage or transportation condition. A flexible arrangement of clamps, and open spaces on the work surfaces allows a user to arrange desk top contents in a variety of utilitarian ways. Provision is also made for variable spacing between the plate-like members so that the desk lower level may accommodate thick or bulky items, or so that the desk may be configured more thinly if only comparatively thin items are to be arranged on the lower level.

22 Claims, 4 Drawing Sheets

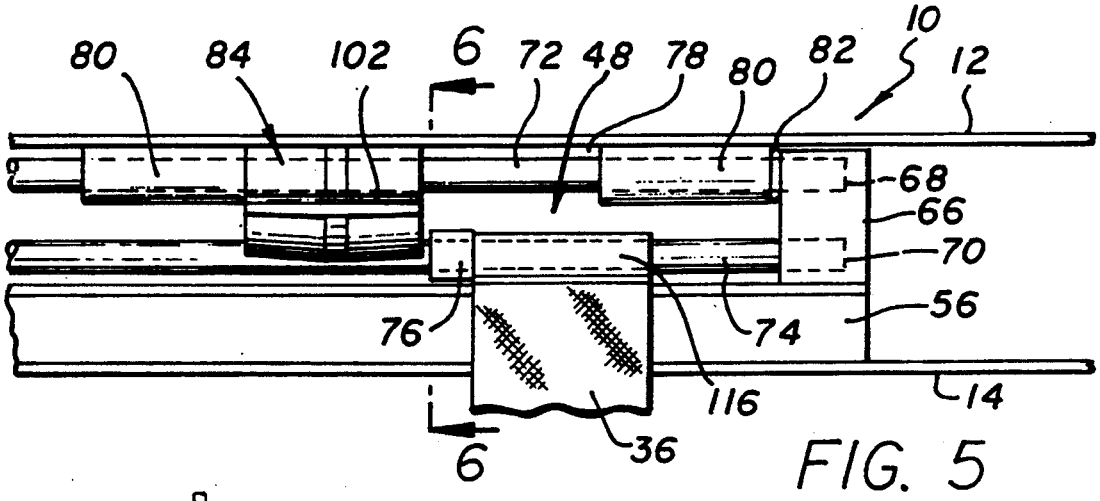
FIG. 5
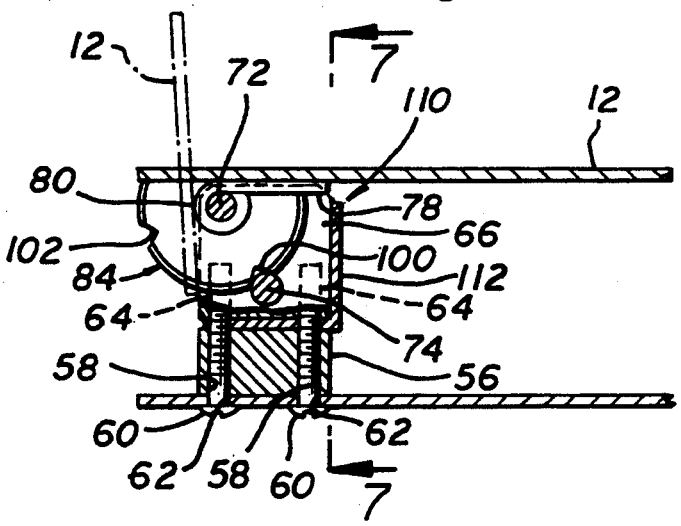
FIG. 6
FIG. 7
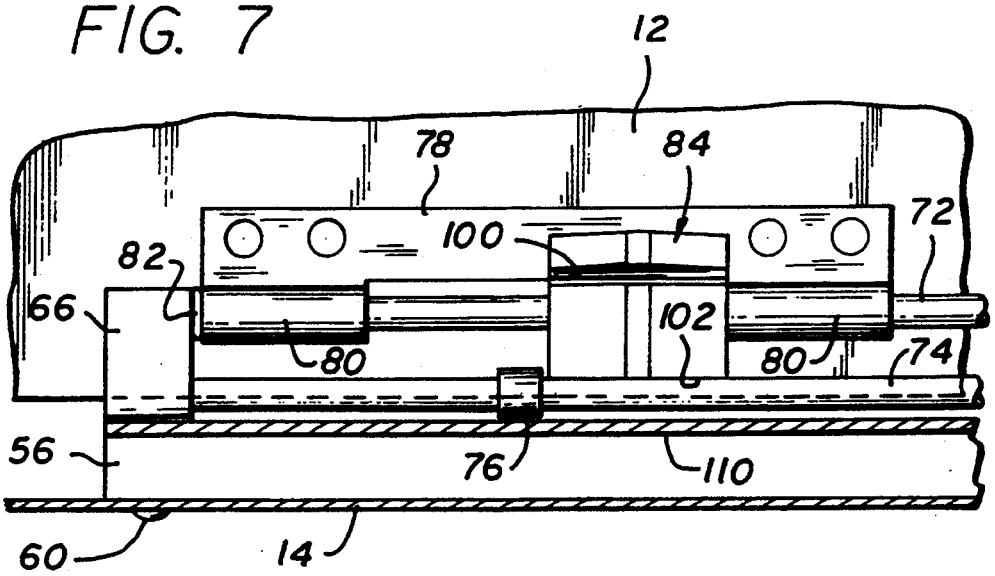

LAP TOP DESK

BACKGROUND OF THE INVENTION

1. Field of the Invention

The present invention is in the field of clip boards, lap boards, pilot's knee or lap clip boards, and special purpose lap top work organizers or desks. More particularly, the present invention relates to a two-level lap top desk especially providing a combination, arrangement, and cooperation of features not heretofore available to pilots for their assistance in holding and presenting to a pilot in an aircraft cockpit selected ones of the various and multiple charts, maps, notes, timers, calculators, air traffic control instructions, instrument reading records, and other assistance items which pilots need to use and refer to in their flying.

2. Related Technology

From the early days of aviation, pilots have been known to use various knee or lap boards to hold maps, navigation charts, and various other necessary items in a more or less useable position of presentation for the pilot within the frequently-cramped confines of an aircraft cockpit. For comparatively slow and simple flying conditions in uncrowded skies, simple clip board structures merely adapted to secure to a pilot's leg were sufficient. For example, a pilot's clip board is known in accord with the U.S. Pat. Des. No. 164,269, issued in 1951 to W. L. Whittier. The Whittier clip board appears to include a curved lower support plate by which the clip board may rest upon a pilot's upper leg, there to be secured by a strap. Upon the curved support plate is disposed a clip board with clamps at both top and bottom for receiving maps and papers for note taking, etc. The clip board of Whittier also appears to perhaps offer a limited storage capacity for items like pencils, for example.

A more recent pilots lap board, which is still indicative of comparatively simplistic flying conditions with a minimum of assistance items needed by the pilot is seen in U.S. Pat. No. 3,791,314, issued in 1974 to P. L. Berretta. The Berretta lap board folds to open like a book and includes a retention device to hold the two sides of the lap board in alignment with one another. Each side of the lap board includes a clamp for retaining papers or maps, etc., placed thereon. However, the Berretta lap board relies upon simple friction strips on the underside to prevent the board slipping from a pilot's lap.

Along the same line is the document holder taught by U.S. Pat. No. 4,243,249, issued in 1981 to H. C. Goss. The document holder of the Goss patent appears to be a rather conventional clip board having a paper clamp at each of the top and side, and being mounted rotationally upon an arcuate leg-engaging support plate. A strap is provided to secure the support plate to a pilots leg.

Each of the above-identified, and other known pilot's lap desks is deficient in some respect, especially in view of today's very demanding flying conditions. Some lap desks provide insufficient working surface, while others are awkward or unwieldy to use. Still others are not sufficiently secured on the pilot's lap, or don't adequately secure papers, charts, maps, and other items so that the pilot need not be concerned about dropping one of these necessary items at a critical time in his flight. Still other lap desks don't present the materials on the desk to a pilot in a useable or easily viewed arrangement. Some desks may even obscure the pilot's view of some of the desk items or of aircraft controls or instruments, so that a necessary item is not readily available to be used or referred to by the pilot when it is needed, or so that the pilot's use of his lap desk compromises his attention to the aircraft and its flight.

With present high-speed general aviation aircraft, and crowded skies around many airports, a pilot's work load is so high that he simply can not afford to be hindered in any way by deficiencies of a pilot's-assistance appliance, such as his lap desk. This appliance should be so constructed and arranged that maximum utility and ease of use results without much attention on the pilot's part to the use of the desk itself. The times when a pilot most needs to use or refer to the assistance items such as charts for air traffic control areas and airport approach patterns, are the times when he can least afford to be hampered by an inefficient or cumbersome lap desk.

Finally, some lap desks are not convenient to carry or store when they are not in use. If a lap desk will not fit into the pilot's chart case or into an attache case, it presents yet another undesirable loose item which the pilot must carry by hand to and from the aircraft. In addition to all of the in-flight features desired for a pilot's lap top desk, it additionally should be compact and easily carried in a chart case or attache case, or by hand with no concerns for loose items falling out of the desk to be lost.

SUMMARY OF THE INVENTION

In view of the above, the present invention provides a pilot's lap desk which includes a first relatively larger lower plate-like member which may rest upon the pilot's lap, there to be secured by a dual-purpose strap upon which the pilot sits, and a second relatively smaller upper plate-like member hingeably and slidably supported in spaced parallel relation above the lower member. Each of the plate-like members provides a working surface upon which various assistance items for the pilot may be secured. The upper plate-like member in a first position is congruent with the lower member at one end of the latter so that the opposite end of the lower member is exposed and available for use, as is all of the work surface of the upper member. The upper member is both slidable laterally in a direction away from the opposite end of the lower member to a second position exposing a larger portion of the lower member while all of the work surface of the upper member remains available to the pilot, and hingeable upwardly at a near edge of the upper member so that all of the work surface of the lower member is exposed.

In its upwardly hinged position, the upper member lays adjacent the chest of a seated pilot so that the pilot's view of the work surface of the lower member and of the aircraft controls and instruments is unobstructed. In each of its parallel or upwardly hinged positions the lower member is retained in position by a hinge detent structure which allows free sliding movement of the upper member in its parallel positions, but which inhibits sliding movement in the upwardly hinged position of the upper member. The structure of the desk which provides for its hinging, sliding and detenting of the upper and lower members is arranged also to provide a substantially uniform detent action regardless of the relative position of sliding movement of the members, as well as providing an abutment arrangement which contributes to a smooth jam-free operation of the desk.

Provided upon the lower and upper members are various clamps and open spaces on which charts, maps, timers, clocks, calculators, note pads, and other pilot assistance items may be arranged and secured in a variety of arrangements to suit the preferences of particular pilots. Additionally, the spacing between the upper and lower members is adjustable by insertion or removal of spacers therebetween to allow a pilot to secure a relatively bulky chart book, for example, in the desk, or to allow a pilot who uses more compact chart pages, to have a more compact desk. The operation of the hinging, sliding and detenting structure of the desk is not affected by this adjustment for thickness of the desk.

Additionally, when the lap top desk is not in use, it presents a compact package fitting easily into a pilot's chart case or attache case. The dual-purpose strap encompasses the upper and lower members, and all the assistance items secured thereto, to more securely hold all these contents of the desk in place while preventing sliding movement of the upper member and storing the strap itself so that it does not dangle loose.

The present lap top desk provides unprecedented utility to an aircraft pilot in holding and presenting to the pilot various assistance items. The dual level arrangement and variable configurations of the desk provided by the sliding and hinging relationship of the upper and lower members allows the pilot to, for example, arrange his assistance items in a programmed or sequenced order on the desk surfaces. A pilot may choose to arrange his desk with a regional map on the upper member, and a note pad on the exposed portion of the lower member. With the upper member in its first position, the regional map will be immediately in front of the pilot, with the exposed area of the lower member available for note taking on the note pad. Sliding aside the upper member gives quick access to, for example, a timer, clock, calculator, or other additional item on the lower member while still allowing the pilot to refer to the regional map on the upper member. Sliding aside the upper member moves the regional map a few inches to the side, but does not prevent the pilot making reference to the map quite easily.

When the pilot enters a terminal air traffic control area at an airport, and needs specific information about a landing traffic pattern, for example, he can flip up the upper member and access his Jeppesen, or other, airport local traffic control charts or information, with the no-longer-needed regional map on the upper member out of the way adjacent his chest. In this position of the lap top desk, all of the items on the lower member are fully exposed and available for use or reference by the pilot. On the other hand, should the chosen airport not be available so that reference once again to the regional map is necessary, simply flipping back down the upper member gives the pilot immediate access to the regional map with its presentation of other local airports and radio frequency information so that an alternative landing site may be selected. The above description is just an example of how a pilot may choose to arrange his flight assistance items in the present lap top desk. Other preferred arrangements of assistance items on the lap top desk are, of course, possible and are allowed easily by the present invention.

The above, and other, advantages of the present inventive lap top desk will be apparent from a reading of the following detailed description of a single preferred embodiment of the invention taken in conjunction with the appended drawing Figures, in which:

BRIEF DESCRIPTION OF THE DRAWINGS

FIG. 5 is an enlarged fragmentary view of a portion of FIG. 4A;

FIG. 6 provides a fragmentary cross sectional view taken at section line 6—6 of FIG. 5, and looking in the direction of the arrow;

FIG. 7 is a fragmentary cross sectional view like FIG. 6, but showing parts of the lap top desk in alternative operative positions;

DETAILED DESCRIPTION OF A PREFERRED EMBODIMENT

Figure 1:
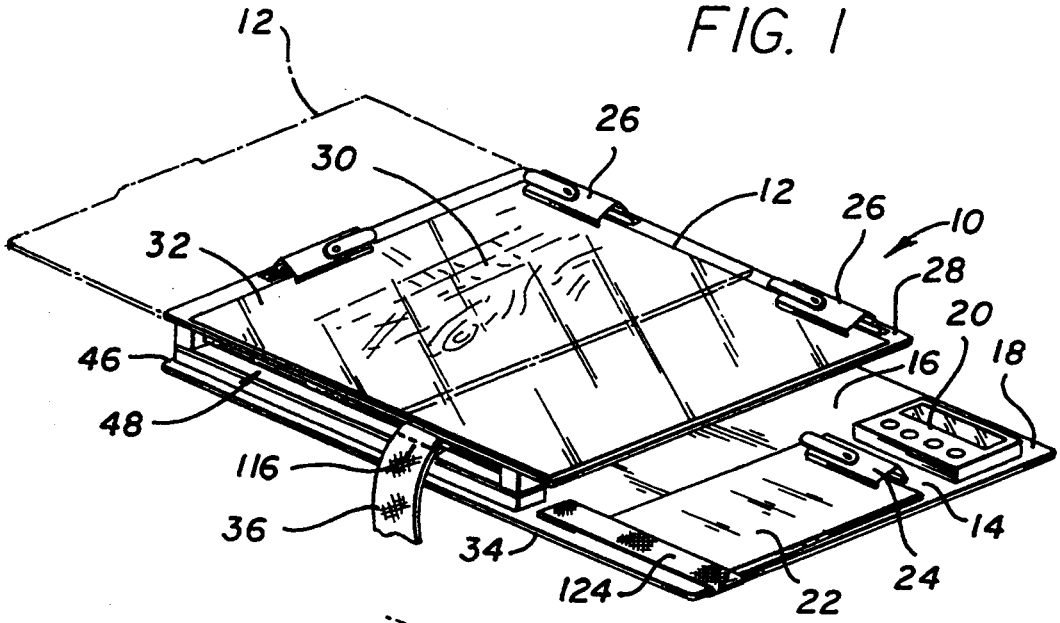
FIG. 1 provides a perspective view of a lap top desk embodying the present invention, and showing parts thereof in alternative of operative positions by use of dashed lines.
Figure 2:
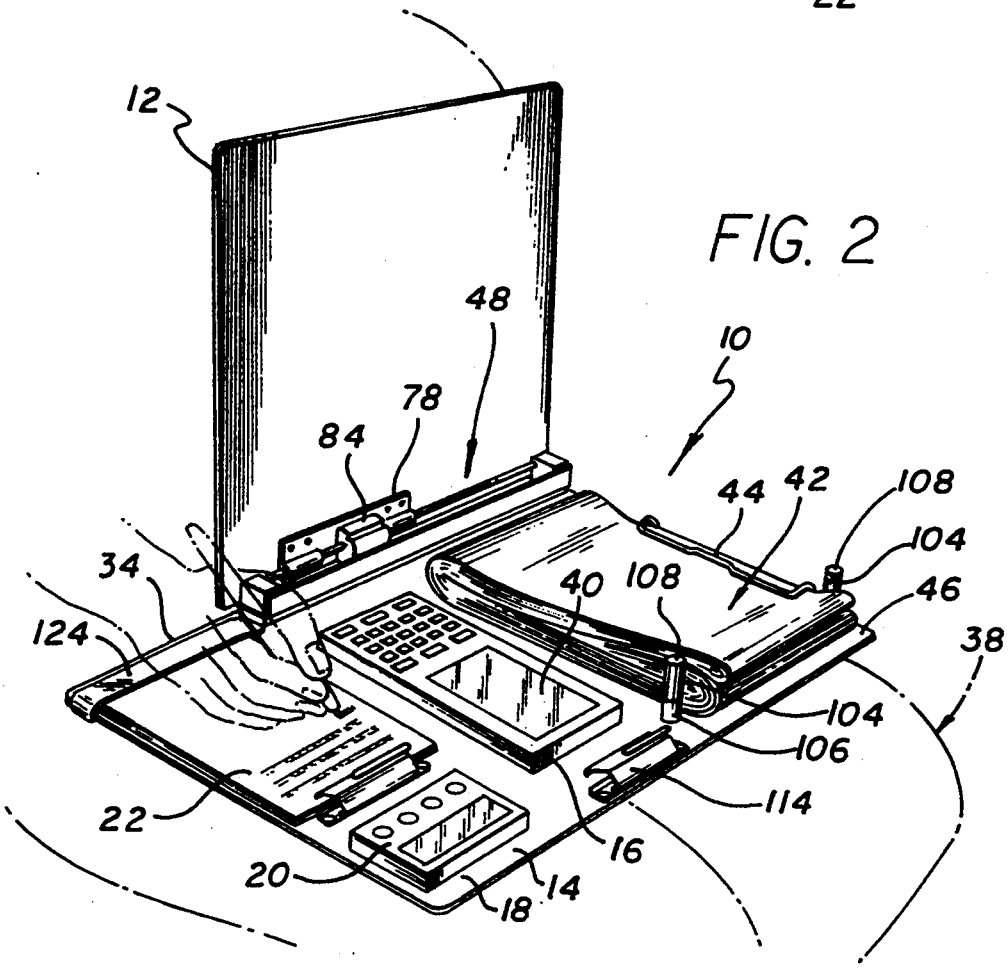
FIG. 2 is a perspective view of the lap top desk in use in an alternative operative position giving access to materials at a level of the desk not visible in FIG. 1.

In order to gain a generalized familiarity with the preferred embodiment of the invention, by viewing FIG. 1 and 2 in conjunction, with attention first to FIG. 1, the reader will see that a lap top desk 10 is shown with an upper plate-like member 12 carried by and disposed in congruent spaced parallel relation above a lower plate-like member 14. Both of the plate-like members 12 and 14 are rigid and rectangular. The lower member 14 has an upper surface 16, and includes a portion 18 protruding rightwardly beyond the upper member 12 in the relative positions of these members depicted in FIG. 1. Upon the portion 18 is presented, for example, a clock/timer 20, which may be secured by double-sided tape or with a hook-and-loop fastener like Velcro, for example. Also secured on the lower member 14 at portion 18 thereof is a pad of note paper 22. A clamp device 24 is secured to the member 14 at portion 18 for holding the pad of paper to the desk 10. FIG. 1 also shows that the desk 10 includes a plurality of similar clamps 26 on the upper surface 28 of upper member 12, by which a map 30, for example, may be held to the desk 10. A transparent plastic overlay sheet 32 allows temporary notations to be made thereon with a washable marker while not damaging the underlying map 30. From a rear edge 34 of the desk 10, a flexible web strap 36 extends for a purpose more easily understood by reference to FIG. 2.

In FIG. 2, the desk 10 is seen on the lap of a human user 38, who draws the strap 36 between the legs and sits upon it so that the desk 10 will not slip away. The lower plate-like member 14 rests upon the upper legs of the user 38 so that the upper surface of member 12 and the right-hand portion 18 of member 14 are presented to the user 38 in the relative position of these members depicted in FIG. 1, In FIG. 2, the upper member 12 is seen hinged upwardly to a position adjacent the chest of the user 38 to reveal materials, such as a calculator 40, and a book of instrument approach charts 42, secured to the member 14 leftwardly of the portion 18. In order to secure the chart book 42, a clamp device 44 is affixed to the lower member 14 adjacent to the left edge 46 thereof. The calculator 40 may also be secured to the lower member 14 using double-sided tape, or alternatively, with a hook-and-loop fastener material, such as Velcro, if desired.

Figures 3, 4A, 4B:
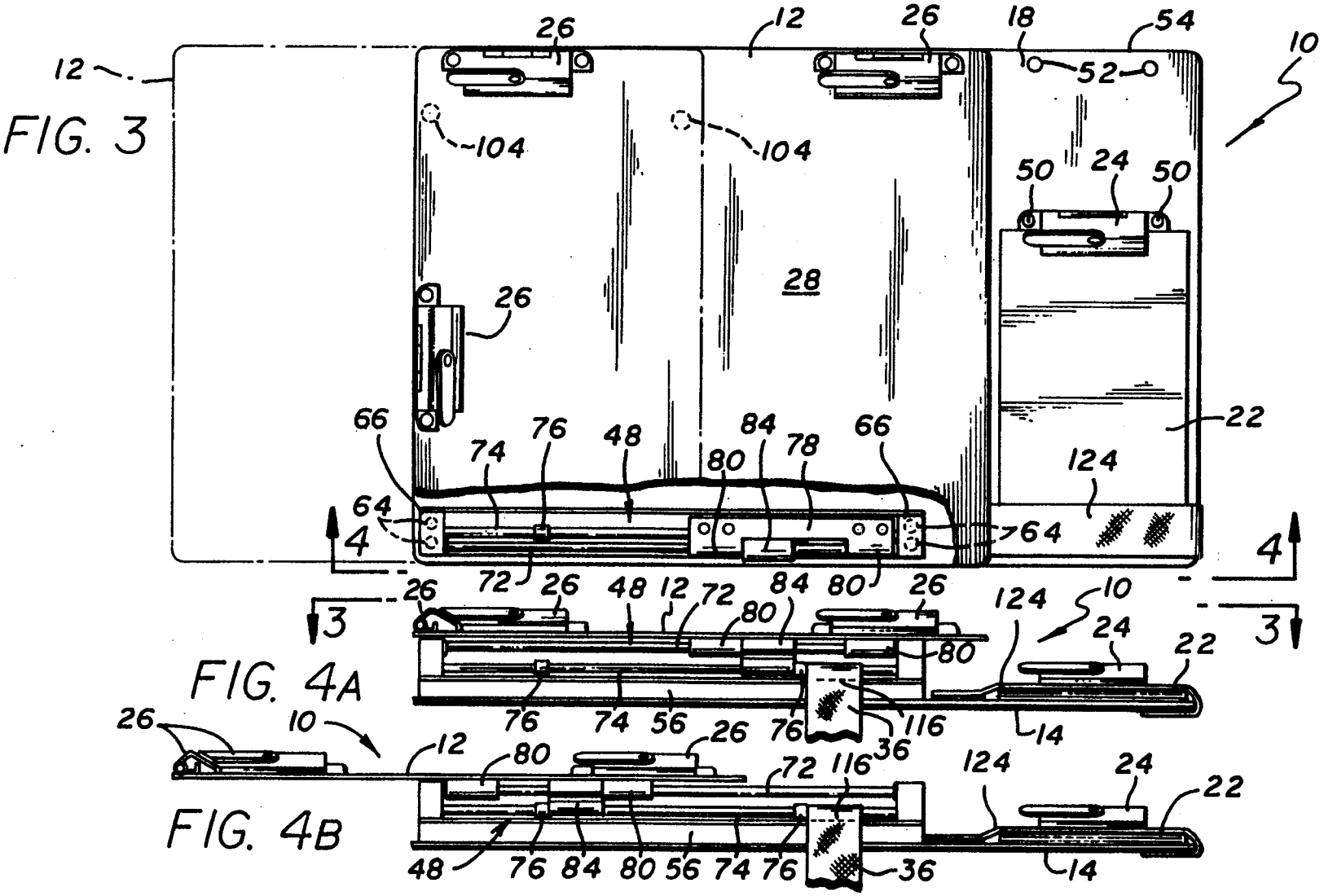
FIG. 3 is a plan view of the lap top desk seen in FIGS. 1 and 2, with parts thereof broken away for clarity of illustration.
FIGS. 4A and 4B are elevation or edge views of the lap top desk seen in FIG. 3, and taken generally in the direction of the view arrows 4—4 of FIG. 3 to show the lap top desk respectively in the two alternative positions depicted by solid and dashed lines in FIG. 1, and also including in FIG. 4A an arrowed view line 3—3, which is indicative of the direction of view for FIG. 3.

In the event the user wishes to use the calculator 40 while still being able to refer to the map 30 on the upper plate-like member 12, this member may be freely and easily slid leftwardly from the position seen in solid lines in FIG. 1, to the position depicted with dashed lines in this Figure. Member 12 is also freely slidable back to its solid line position of FIG. 1. As will be further explained, a glide, hinge, and detent assembly (which is hereinafter referred to as a hinge), and which is generally referenced with the numeral 48, connects the upper member 12 and lower member 14 for relative sliding and hinging movement. Additionally, the hinge 48 includes a dual-function detent feature which will be further explained, and which retains the relative pivotal positions of hinging movement of the members 12 and 14, as is seen in FIGS. 1 and 2. Also, regardless of whether the upper member 12 is in its first rightward position depicted in solid lines on FIG. 1, or is slid leftwardly to its second position depicted in FIG. 1 with dashed lines, upward hinging of the member 12 to the position depicted in FIG. 2 also causes the hinge 48 to resist further sliding of the member 12. Thus, the member 12 does not undesirably and distractingly slide to and fro when raised out of the way to the position of FIG. 2. FIGS. 4A and 4B, which are further described below, also depict the upper member 12 in its alternative translated positions seen in FIG. 1.

Referring now more particularly to FIG. 3, the desk 10 is seen in plan view without the clock/timer 20 and pad 22 so that it may be seen that the clamp 24 is secured to the member 14 by a pair of threaded fasteners 50 passing through holes (not visible) in the lower member 14. The member 14 defines a pair of holes 52 spaced above the illustrated position for the clamp 24, and by which the clamp may be alternatively secured adjacent the top edge 54 of the member 14. As will be appreciated by a complete reading of this description of the preferred embodiment of the invention, an important aspect of my invention is the flexibility of arrangement which allows users of the desk to select for themselves how assistance materials are presented for use.

Still referring to FIG. 2, and additionally referring to FIGS. 3–8, it will be seen that the hinge 48 is itself disposed upon an elongate spacer bar 56 which rests upon the lower member 14. The spacer bar 56 at each end thereof defines a pair of through holes 58 passing threaded fasteners 60, which also pass through aligned holes 62 of the lower member 14 to threadably engage corresponding blind holes 64 in a pair of spaced apart support blocks 66 (best seen viewing FIGS. 6 and 7). Each of the support blocks 66 defines a pair of blind bores 68,70 (best seen in FIG. 5) facing or opening toward the other support block. In the bores 68, a hinge rod 72 is received to extend between the support blocks 66. Similarly, in bores 70 a detent rod 74 is received and extends between the support blocks 66. Detent rod 74 includes a pair of fixed collars 76 which are spaced apart and are also spaced from the support blocks 66. The two rods 72,74 are substantially parallel to each other, are offset vertically relative to one another, and are advantageously offset horizontally relative to one another, as will be further explained.

Riveted to the underside of upper member 12 is a hinge plate 78 including a pair of spaced apart hinge knuckles 80. As is seen in FIGS. 4A and 4B, the hinge knuckles 80 encircle and are slidable along hinge rod 72 to allow translational movement of the upper member 12 between its solid and dashed line positions of these Figures and FIG. 1. Because the hinge plate 78 includes a pair of the hinge knuckles 80, which are spaced apart on the hinge rod 72, the upper member 12 is well supported even though the hinge rod 72 is intentionally somewhat flexible. That is, the upper member 12 well resists side to side rocking so that a solid stable surface is presented to a user who may wish to write on the cover sheet 32. At the limits of sliding movement of the knuckles along hinge rod 72, a corresponding one of the knuckles confronts one of the support blocks 66. In order to prevent a harsh impact of the hinge knuckles against the support blocks when the end of this sliding movement is reached, an annular resilient 0-ring type of cushion member 82 is interposed on the rod 72 adjacent each of the support blocks 66.

Figure 8A:
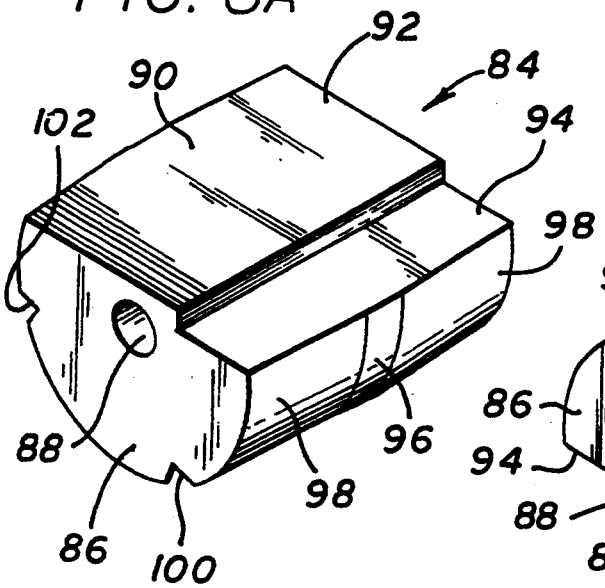
FIGS. 8A and 8B are perspective isolation views of a component part of the lap top desk seen in the other Figures.
Figure 8B:
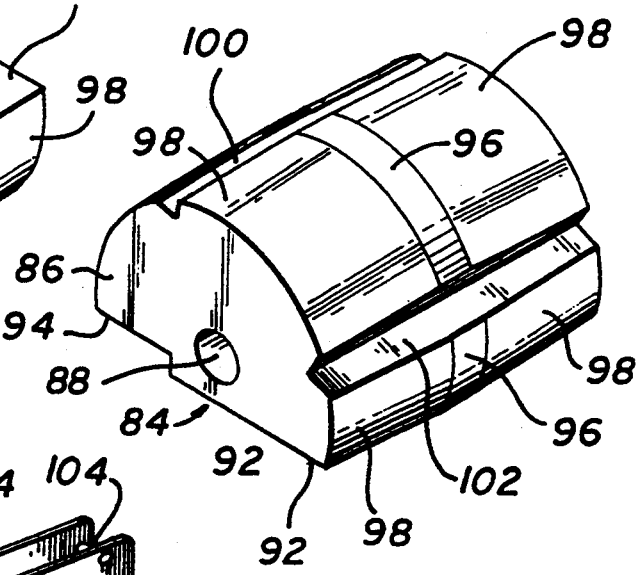

Slidably received also on the hinge rod 72 between the hinge knuckles 80 is a rotor member 84, which is also perspectively illustrated in isolation in FIGS. 8A and 8B. Referring to these perspective Figures, it will be seen that the rotor member 84 includes a generally semicylindrical body 86, defining a through axial bore 88 slidably and pivotally receiving the hinge rod 72. A stepped engagement surface 90 of the body 86 at a portion 92 slidably engages the underside of upper member 12, and at a portion 94 slidably engages the hinge plate 78, so that the rotor 84 is translatable relative to these latter two structures but must pivot with them around the hinge rod 72. The body 86 includes a central semicylindrical surface portion 96, and a pair of oppositely extending longitudinally and outwardly tapering conical surface portions 98, one on each side of the central surface portion 96. Because of the cooperation of the surface portions 96 and 98, the rotor member 84 is crowned, and has an effective radius at its ends which is less than the radius at the central cylindrical surface portion 96.

Traversing the surface portions 96,98 of the rotor member 84 are a pair of generally V-shaped axially extending grooves 100,102, the first of which is of slightly greater depth than the latter. Viewing FIG. 6 along with FIGS. 4, it is seen that in the positions of the upper member 12 seen in FIG. 1, the detent rod 74 is slidably received in the deeper groove 100, and that the rotor member 84 is captured in its sliding movement along hinge rod 72 between the hinge knuckles 80 and the collars 76 of the detent rod 74. In other words, the rotor member 84 is cooperatively constrained by the hinge knuckles 80 and collars 76 to a central portion of the detent rod 74 spaced away from the support blocks 66. Thus, the upper member 12 along with rotor member 84 is freely slidable leftwardly and rightwardly along the hinge rod 72 with the rotor member sliding relative to the detent rod 74 received in groove 100, with the rotor member sliding from side to side between the hinge knuckles 80 as the collars 76 cooperatively constrain the rotor to the central part of the detent rod 74.

The rotor member 84 has a radius from the center of bore 88 which receives hinge rod 72 to the curved surface of section 96 that is greater than the distance from the center of hinge rod 72 to the surface of detent rod 74. Therefore, as the upper member 12 is pivoted upwardly to its position seen in FIGS. 2 and 7, the hinge rod 72 and detent rod 74 spring apart slightly to allow the detent rod to slide across surfaces 96,98 and into the shallower groove 102, viewing FIG. 7. In this upwardly hinged position of the upper member 12, the rotor member 84 frictionally engages detent rod 74 to resist sliding movement along hinge rod 72. That is, the detent rod 74 is pressed into the groove 102 by the resilient action of the two rods 72,74, which are outwardly bowed by the interposed rotor member 84. Also, because of the horizontal offset of the two rods 72,74, the rotor member is urged horizontally against the now nearly-vertical underside surface of member 12 and hinge plate 78, as is best appreciated by viewing FIG. 6. Also, groove 102 is angularly positioned so that the detent rod 74 also applies a counterclockwise moment to the rotor member 84 (viewing FIG. 6) to urge the member 12 into engagement at its rear edge with the blocks 66, as is shown in dashed lines.

To further explain, the engagement surface 90 is urged into frictional engagement at its surface portions 92,94 with the underside of upper member 12, and with hinge plate 78, respectively, to resist sliding motion of the upper member 12 relative to the rotor member 84. Thus, the upper member 12 is constrained from free sliding motion when it is pivoted upwardly to the position of FIG. 2. And also, the engagement of the upper member 12 with the blocks 66 in the upper position enhances its rigidity. This constraint of sliding motion of the upper member 12 is effective regardless of where this member is located in its sliding motion relative to the lower member 14. Of course, the upper member 12 may be downwardly hinged to return to the positions of FIG. 1. In these positions, the upper member is once again pivotally detented by the detent rod being received into the deeper groove 100, but is again free to slide side to side together with the rotor member 84.

Further, because the rotor member 84 is crowned to present a smaller radius to the detent rod when the rotor member is closer to the support blocks 66, the pivotal detenting action of this rotor member is substantially uniform. That is, the effective stiffening of the detent rod closer to the support blocks does not result in a stiffer detenting action. Also, the collars 76 prevent the rotor member from so closely approaching the support blocks 66 that it could wedge between the hinge rod and detent rod.

Viewing FIG. 2 once again, it is seen that I provide a pair of spaced apart support posts 104, which are threaded on screws (not shown) passing through holes in the lower member 14 and through spacer bushings 106. The support posts 104 are positioned on either side of the space in which the instrument approach charts 42 are illustrated, viewing FIG. 2, and have upper end surfaces 108 on the one hand slidably engaging the under side of the upper member 12, and on the other hand both supporting this member regardless of where it is located in its sliding movement. Recalling the spacer bar 56, it may be appreciated that a user of the desk 10 may choose to use only a few pages of an instrument approach chart book on the lower member 14, or may choose to otherwise arrange his desk so that a lesser depth is needed for the lower level of assistance materials on this lower member. In such case, the user may remove the spacer bar 56, and the bushings 106 to configure a more compact desk 10. Finally, it should be noted that an L-shaped partition member 110 (best seen in FIGS. 6 and 7) is captured between the support blocks 66 and the lower member 14. This partition member 110 includes an upright leg portion 112 extending from one support block 66 to the other to prevent materials on the lower member 14 of the desk becoming jammed in the hinge 48. Also, on the lower member 14 above the location of the calculator 40, I provide an additional clamp member 114 like the clamps 24,26 for use by those users who prefer to dispose an additional pad of paper, for example, at this location.

Figure 9:
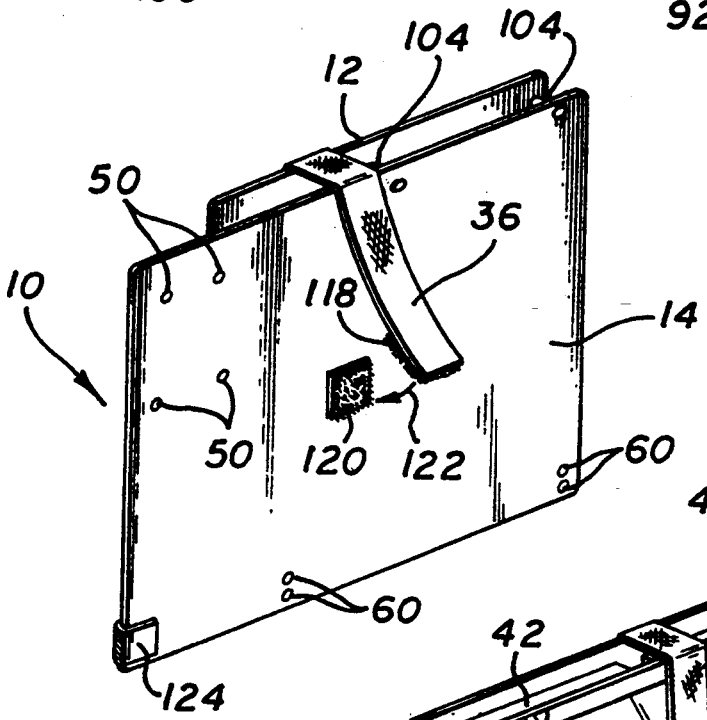
FIGS. 9 and 10 are respective rear and front perspective views of the lap top desk seen in the preceding Figures and shown in a storage or transportation condition.
Figure 10:
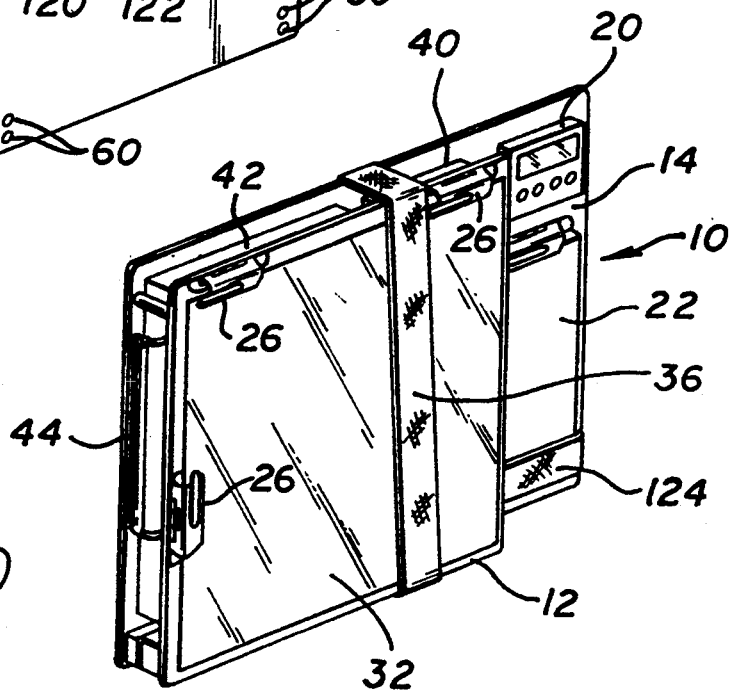

FIGS. 9 and 10 depict the strap 36 in its alternative use to securely close the desk 10 for transportation and storage. Viewing FIGS. 4 and 5, it is seen that the strap 36 at an end hem 116 thereof (best seen in FIG. 5) is received on the detent rod 74 outside of the central portion of this rod where the rotor member 84 is slidable. That is, the strap 36 is captured between one of the collars 76 and the right-hand one of the support blocks 66, viewing FIG. 5. At its opposite end, the strap 36 includes a portion 118 of hook-and-loop material. On the back side of the lower member 14, the other portion 120 of the hook-and-loop material is adhesively secured at a location such that when these portions 118, 120 are joined (as depicted by arrow 122), the strap engages the left edge of one of the clamps 26 on the upper member 12. Thus, in addition to the frictional engagement of the strap 36 with the upper member 12 to retain the desk in its transportation condition, I provide a positive mechanical engagement of strap 36 with one of the clamps 26 to prevent sliding of the upper member leftwardly out of the solid line position of FIG. 1. Also, viewing FIG. 1, I provide a small web strap 124 secured by Velcro at each end to a pair of small Velcro pads, one of which is adhesively secured to the lower member 14 leftwardly of the paper pad 22, and the other being adhesively secured rightwardly of the pad 22 on the back face of the lower member 14, as is seen in FIG. 9. This web strap 124 is useful to hold in place the pages of the paper pad 22, but is completely removable for use of the desk 10. The result is a secure and compact package which may easily be dropped into a pilots chart case, for example, with little likelihood that any of the contents of the desk 10 can fall out to be lost.

To recap the functions provided by the hinge 48 of the preferred embodiment of the invention, the upper member 12 may be freely slid side to side while in its lowered position seen in FIGS. 1 and 3. The upper member is detented when placed in either of its lowered or upwardly hinged positions, the upwardly hinged positions being seen in FIGS. 2 and 7. That is, in order to pivot the upper member 12 from either of the lowered or raised positions to the other of these positions, and regardless of where the upper member is located in its side to side sliding movement relative to the lower member 14, the user must overcome the detent action of the hinge 48. Thus, the desk does not fall open if placed on edge, and stays in its open position of use on the user's lap when the upper member 12 is pivoted upwardly to this use position. Also, the underside surface of the upper member 12 is non-reflectively treated, for example, by sand blasting and black anodizing, to provide a low reflection of light from this surface onto the aircraft instruments. Additionally, besides being detented in its upwardly hinged position, the upper member 12 is also constrained from free sliding motion side to side when in this position so that the pilot is not distracted by the upper member moving around undesirably while this member is pivoted to its open position to allow use of and reference to the assistance items on the lower member 14 of the desk 10.

While the present invention has been depicted and described, and is defined by reference to a single particularly preferred embodiment of the invention, such reference does not imply a limitation on the invention, and no such limitation is to be inferred. The invention is subject to considerable modification and supplementation which will occur to those ordinarily skilled in the pertinent arts. For example, the rotor member 84 may include one or more additional grooves like grooves 100,102. Consequently, the upper plate 12 would detent in three or more positions. The invention is intended to be limited only by the spirit and scope of the appended claims, which also provide a definition of the invention.

What is claimed is:

1. A lap top desk comprising:

a plate-like first member;

a plate-like second member, each of said first member and said second member providing a respective working surface;

means for hingeably and slidably supporting said second member in a first position in spaced parallel relation congruently above said first member to conceal a portion of said working surface of said first member with all of said working surface of said second member being available for use, and for permitting said second member to slide laterally in a direction away from an end of said first member to a second position in spaced parallel relation with said first member exposing another portion of said working surface of said first member while all of said working surface of said second member remains available for use, and for allowing said second member to hinge upwardly adjacent to an edge of the first member so that said second member does not conceal said first member and all of said working surface of said first member is available for use.

2. The invention of claim 1 including means for hingeably and slidably supporting providing both pivotal hinging movement and sliding lateral movement between said first and said second members.

3. The invention of claim 2 further including detent means for providing a substantially uniform detent action on hinging movement of said second member regardless of the relative position of sliding movement of the members between said first and second positions.

4. The invention of claim 2 wherein said means for hingeably and slidably supporting includes means for providing a detent action on said second member in each of said spaced parallel position and said upwardly hinged position thereof.

5. A lap top desk comprising:

a plate-like first member;

a plate-like second member, each of said first member and said second member providing a respective working surface;

means for hingeably and slidably supporting said second member in a first position in spaced parallel relation congruently above said first member to conceal a portion of said working surface of said first member with all of said working surface of said second member being available for use, and for permitting said second member to slide laterally in a direction away from an end of said first member to a second position in spaced parallel relation with said first member exposing another portion of said working surface of said first member while all of said working surface of said second member remains available for use, and for allowing said second member to hinge upwardly adjacent to an edge of the first member so that said second member does not conceal said first member and all of said working surface of said first member is available for use;

said means for hingeably and slidably supporting providing both pivotal hinging movement and sliding lateral movement between said first and said second members; and said means for hingeably and slidably supporting including an elongate hinge rod and a spaced parallel elongate detent rod both carried by one of said first and second members, a hinge plate carried by the other of said first and second members having a hinge knuckle pivotally and slidably embracing said hinge rod, and a rotor member slidable on said hinge rod and slidable but nonrotational relative to said other of said first and second members to relatively pivot therewith, said rotor defining a pair of detent grooves parallel with said detent rod and respectively receiving the latter in said parallel and said upwardly hinged relative positions of said first and second members.

6. The invention of claim 1 wherein the one of said detent grooves which receives said detent rod in said upwardly hinged relative position of said members is shallow to maintain said detent rod deflected and frictionally engaged with said rotor member thereby to resist sliding lateral movement of said second member in said upwardly hinged relative position thereof.

7. The invention of claim 6 wherein said hinge rod and said detent rod are offset horizontally relative one another to in said upwardly hinged position of said second member bow said hinge rod toward said second member and engage said rotor member frictionally with said second member to resist sliding lateral movement thereof.

8. The invention of claim 7, wherein said hinge plate includes a pair of spaced apart hinge knuckles each pivotally and slidably embracing said hinge rod, said rotor member being received between said hinge knuckles.

9. The invention of claim 8, wherein said detent rod further includes a pair of spaced apart collars secured thereto on opponent sides of said rotor member and which are engageable by said rotor member to constrain the latter to a relatively more resilient central portion of said detent rod.

10. The invention of claim 5 further including a pair of spaced apart support blocks securing to said one of said first and said second members, said support blocks carrying said hinge rod and said detent rod.

11. The invention of claim 10 additionally including a pair of resilient members received on said hinge rod and interposing individually between one of said hinge knuckles and one of said support blocks.

12. The invention of claim 10 additionally including an elongate spacer member interposing between said support blocks and said first member.

13. The invention of claim 10 further including an elongate L-shaped member interposed between said pair of support blocks and said first member, said L-shaped member including an upright wall portion bounding said working surface of said first member.

14. The invention of claim 5 additionally including a flexible strap member securing to said lap top desk at a rear edge thereof.

15. The invention of claim 14 wherein said flexible strap includes a hem received upon said detent rod.

16. The invention of claim 15 wherein said flexible strap further includes separable securing means at a free end of said strap, said first plate-like member on a lower surface thereof including cooperating securing means for attachment with said strap in a position in which the latter encircles said first and second plate-like members.

17. A pilot's lap top desk comprising:

a relatively larger plate-like lower member which may rest upon the pilot's lap;

a pair of spaced apart upwardly extending support blocks disposed at a rear edge of the lower member;

a pair of rod members spanning between the pair of support blocks;

a hinge plate pivotally and slidably received on one of the pair of rods;

a relatively smaller plate-like upper member secured to the hinge plate for pivotal and lateral sliding movement therewith relative to said lower member between a first position of upwardly spaced parallel congruence with said lower member at one end thereof and a second position laterally displaced from said first position to overhang said lower member, said upper member also being pivotal upwardly from said first and second positions to reveal all of said lower member; and a rotor member slidably and pivotally received on said one rod member, said rotor member slidably and nonrotationally engaging said upper member and defining a semicircular surface traversed by a pair of detent grooves and across which the other of said pair of rod members slides in response to pivotal relative movement of said plate-like members so as to move said other rod member between said pair of parallel detent grooves, said other rod member being respectively received into one of said pair of detent grooves in said first and second positions thereof and into the other of said pair of detent grooves when upwardly hinged.

18. A lap-top desk comprising:

a flat lower desk plate, a flat upper desk plate, and pivoting and sliding hinge means for mounting the upper plate to the lower plate for pivotable and slidable motion, said upper plate being slidable on said hinge means relative to said lower plate between a home position in which all of the upper plate is positioned above a first part of the lower plate and a second laterally displaced position in which part of the upper plate is above a second part of the lower plate, said upper plate being pivotable on said hinge means between a lower position in which the upper plate is spaced above and is parallel to said lower plate, and an upper position in which said upper plate extends upwardly at an angle to said lower plate.

19. The desk of claim 18 including detent means for holding said upper desk plate in either of said lower and upper positions when said upper desk is in any position between said home and displaced positions.

20. A lap top desk comprising:

a plate-like first member;

a plate-like second member, each of said first member and said second member providing a respective working surface;

means for hingeably and slidably supporting said second member in a first position in spaced parallel relation congruently above said first member to conceal a portion of said working surface of said first member with all of said working surface of said second member being available for use, and for permitting said second member to slide laterally in a direction away from an end of said first member to a second position in spaced parallel relation with said first member exposing another portion of said working surface of said first member while all of said working surface of said second member remains available for use, and for allowing said second member to hinge upwardly adjacent to an edge of the first member so that said second member does not conceal said first member and all of said working surface of said first member is available for use;

said means for hingeably and slidably supporting providing both pivotal hinging movement and sliding lateral movement between said first and said second members;

detent means for providing a substantially uniform detent action on hinging movement of said second member regardless of the relative position of sliding movement of the members between said first and second positions; and means for resisting sliding lateral movement of said second member when the latter is hinged upwardly to reveal said working surface of said first member.

21. A lap top desk comprising:

a plate-like first member;

a plate-like second member, each of said first member and said second member providing a respective working surface;

means for hingeably and slidably supporting said second member in a first position in spaced parallel relation congruently above said first member to conceal a portion of said working surface of said first member with all of said working surface of said second member being available for use, and for permitting said second member to slide laterally in a direction away from an end of said first member to a second position in spaced parallel relation with said first member exposing another portion of said working surface of said first member while all of said working surface of said second member remains available for use, and for allowing said second member to hinge upwardly adjacent to an edge of the first member so that said second member does not conceal said first member and all of said working surface of said first member is available for use;

said means for hingeably and slidably supporting providing both pivotal hinging movement and sliding lateral movement between said first and said second members;

said means for hingeably and slidably supporting includes means for providing a detent action on said second member in each of said spaced parallel position and said upwardly hinged position thereof; and said means for hingeably and slidably supporting includes means for resisting lateral sliding movement of said second member when the latter is pivoted upwardly to reveal the working surface of said first member.

22. A lap-top desk comprising:

a flat lower desk plate, a flat upper desk plate, and pivoting and sliding hinge means for mounting the upper plate to the lower plate for pivotable and slidable motion, said upper plate being slidable on said hinge means relative to said lower plate between a home position in which all of the upper plate is positioned above a first part of the lower plate and a second laterally displaced position in which part of the upper plate is above a second part of the lower plate, said upper plate being pivotable on said hinge means between a lower position in which the upper plate is spaced above and is parallel to said lower plate, and an upper position in which said upper plate extends upwardly at an angle to said lower plate;

detent means for holding said upper desk plate in either of said lower and upper positions when said upper desk plate is in any position between said home and displaced positions; and detent means includes means for preventing lateral sliding motion of said upper plate when it is in said upper position.

* * * * *

UNITED STATES PATENT AND TRADEMARK OFFICE

CERTIFICATE OF CORRECTION

PATENT NO. : 5,388,530

DATED : February 14, 1995

INVENTOR(S) : Frederick B. Jacobus

It is certified that error appears in the above-indentified patent and that said Letters Patent is hereby corrected as shown below:

Claim 6 (Column 10, line 35), delete "1", and substitute therefor --5--.

Signed and Sealed this

Twenty-first Day of October 1997

*Attest:*

*Attesting Officer*

BRUCE LEHMAN

*Commissioner of Patents and Trademarks*